US005337912A

United States Patent [19]

Jochem

[11] Patent Number: 5,337,912

[45] Date of Patent: Aug. 16, 1994

[54] STURDY AEROSOL CAN LID

[75] Inventor: David J. Jochem, Evansville, Ind.

[73] Assignee: Berry Plastics Corporation, Evansville, Ind.

[21] Appl. No.: 983,808

[22] Filed: Nov. 30, 1992

[51] Int. Cl.[5] ..... B65D 41/18

[52] U.S. Cl. ..... 220/306; 220/352; 220/356; 215/321

[58] Field of Search ..... 220/306, 307, 352, 354, 220/355, 356; 215/317, 321

[56] References Cited

U.S. PATENT DOCUMENTS

| | | | |
|---|---|---|---|
| 2,884,160 | 4/1959 | Abplanalp | 220/306 |
| 2,973,881 | 3/1961 | Ostrowitz | 220/306 |
| 3,080,090 | 3/1963 | Young | 220/306 |
| 3,396,866 | 8/1968 | Oppasser | 220/306 |
| 3,414,183 | 12/1968 | Wilcox | 215/321 X |
| 3,565,295 | 2/1971 | Doyle | 220/352 X |
| 4,014,459 | 3/1977 | Robinson | 220/380 |
| 4,029,231 | 6/1977 | Jonsson | 215/256 |
| 4,315,576 | 2/1982 | Murphy et al. | 220/282 |
| 4,346,815 | 8/1982 | Raymor et al. | 220/306 |
| 4,775,062 | 10/1988 | Carle et al. . | |
| 4,961,510 | 10/1990 | Dvoracek | 220/306 X |

FOREIGN PATENT DOCUMENTS 7808591 2/1980 Netherlands .

*Primary Examiner*—Allan N. Shoap
*Assistant Examiner*—Vanessa Caretto
*Attorney, Agent, or Firm*—Barnes & Thornburg

[57] ABSTRACT

A lid is provided for mounting on an annular lip around the top of a can. The lid includes a shell, a lid-retaining portion, and a hook-shaped load-distributing member. The shell has an inner wall and the lid-retaining portion is appended to the inner wall of the shell and positioned to engage the annular lip to hold the lid in place on the can. The hook-shaped load-distributing member is appended to the inner wall of the shell and is positioned to hook onto and engage the annular lip lying around the top of the can. The hook-shaped load-distributing member functions to distribute an external compression load applied to the lid from the lid to the can.

29 Claims, 2 Drawing Sheets

STURDY AEROSOL CAN LID

BACKGROUND AND SUMMARY OF THE INVENTION

This invention relates to lids for mounting on the top of aerosol cans or the like, and particularly to a lid including mounting flanges configured to engage an outer annular lip provided near the top of the aerosol can. More particularly, this invention relates to a sturdy lid that is mounted on an aerosol can to support a heavy weight loaded on top of the lid without deforming the lid so that it bears down against the aerosol spray button and causes premature release of the pressurized contents of the aerosol can inside the lid.

Everyone has seen an aerosol can provided with a plastic lid mounted on top of the can to cover the aerosol spray button. To release the pressurized contents of the can it is customary to remove the lid, hold the can upright, aim the discharge opening in the right direction, and depress the aerosol spray button. Such lids are typically formed in a mold using a plastics material such as polypropylene or high density polyethylene. The lids are usually molded to include a shell and various internal ribs and flanges. Of course, these molded lids can also be used to cover the discharge openings provided in containers other than aerosol cans.

Lidded aerosol cans are typically stacked on top of one another in packing boxes so that large numbers of filled cans can be shipped or warehoused. These boxes often contain many layers of stacked lidded cans and, as a result, the lids on the lower layers of aerosol cans are carrying the heavy weight of all of the cans stacked above in the upper layers. These filled packing boxes are often handled roughly during shipping and warehousing, and this type of handling can also increase the magnitude of the loads applied to the lids on the aerosol cans in the packing boxes. Of course, lidded aerosol cans may also be stacked on top of one another on a shelf to provide an attractive display in a retail store.

One problem with many conventional aerosol can lids is that they do not have a lot of "stacking strength" and thus are not always able to support the heavy weight of a stack of aerosol cans or strong, dynamic impacts of the type frequently encountered during shipping and warehousing. Unless an aerosol can lid has a sufficient stacking strength, it may deform, shift, or collapse somewhat under a heavy static or dynamic load, leading to unexpected discharge of the pressurized aerosol can contents while the lid is still in place on the top of the can.

Some conventional aerosol can lids are molded to include eight to ten vertical stacking ribs arranged around the perimeter of the inner side wall of the lid and spaced apart from one another at even increments. It has been observed that these vertical ribs are sometimes subjected to severe shearing loads created by an overlying heavy stack of aerosol cans or other heavy static or dynamic loads. These severe shearing loads sometimes result in one or more sheared or permanently deformed vertical stacking ribs inside the lid. This unpredictable occurrence sometimes goes undetected until the damage to the lid has already occurred. This damage is characterized by reduction in stacking strength of the lid and creation of an inconsistent or non-uniform stacking area on the ribs. Further, these conventional circumferentially spaced-apart vertical stacking ribs are subject to "plastic rollover" which again results in reduced stacking strength, etc. For example, plastic rollover is characterized by rolling and deforming rather than shearing and can occur wherever there are sharp edges, undercuts, or insufficient draft in the mold. Another problem with some conventional molded aerosol can lids is that it is sometimes difficult to strip these lids out of the mold without causing some deformation to the internal stacking ribs and thereby causing the lid to have reduced stacking strength.

What is needed is a sturdy aerosol can lid that is configured to mount on an aerosol can in such a way as to provide as much stacking strength as possible to prevent damage to the lid in unusual shipping, displaying, or warehousing conditions and thereby prevent premature release of the contents of the aerosol can while the lid is in place on the can. An improved lid having mounting flange means appended to the lid and configured to engage the aerosol can and support heavy compression loads placed on the lid without easily shearing, shifting, or deforming would avoid the shortcomings of conventional aerosol can lids. Ideally, such a mounting flange means would be configured to make it easy to strip the improved lid out of its mold without breaking or shearing the mounting flange means.

According to the present invention, an improved lid is provided for mounting on an annular lip around the top of a can. The lid includes a shell, a lid-retaining portion, and a hook-shaped load-distributing member. The shell has an inner wall and the lid-retaining portion is appended to the inner wall of the shell and positioned to engage the annular lip to hold the lid in place on the can.

The hook-shaped load-distributing member is also appended to the inner wall of the shell and is positioned to hook onto and engage the annular lip lying around the top of the can. The hook-shaped load-distributing member functions to distribute an external compression load applied to the lid from the lid to the can to maximize the compression loading capability of the lid and enhance the stacking strength of the lid.

In preferred embodiments, the hook-shaped load-distributing member has a conical shape positioned inside the shell to lie above the lid-retaining portion. Once the lid is mounted on the can, the annular lip is trapped between the overlying conical hook-shaped load-distributing member and the underlying lid-retaining portion. The annular lip of the can includes a circular bottom edge engaging the lid-retaining portion and a circular top edge engaging the conical hook-shaped load-distributing member.

The conical hook-shaped load-distributing member includes an annular slanted portion that converges toward the central vertical axis of the can and engages the circular top edge of the annular lip. Essentially, the annular slanted portion cooperates with the cylindrical inner wall of the shell to define a circular channel therebetween. When the lid is mounted on the can, the annular lip on the top of the can fits into this circular channel. If a heavy load is placed on top of the lid, the lid is urged downwardly toward the can and the annular slanted portion of the conical hook-shaped load-distributing member transfers that load from the lid to the can. This feature advantageously enhances the stacking strength of the lid as well as to promote part removal during ejection of the part from the mold.

Additional objects, features, and advantages of the invention will become apparent to those skilled in the art upon consideration of the following detailed description of preferred embodiments exemplifying the best ode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
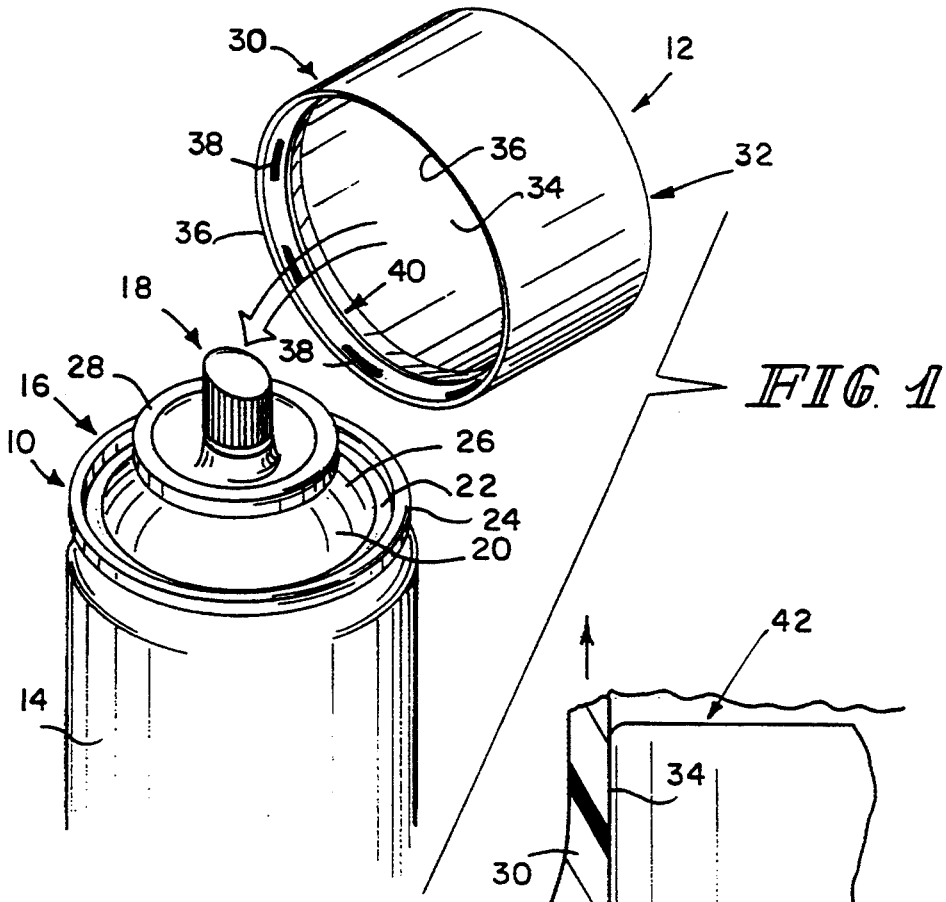
FIG. 1 is a perspective view of an aerosol spray can including a cylindrical body, a top closure member, and a push-to-spray button and a sturdy lid in accordance with the present invention showing an annular hook-shaped load-distributing member appended to the cylindrical inner wall of the hollow lid shell.
Figure 2:
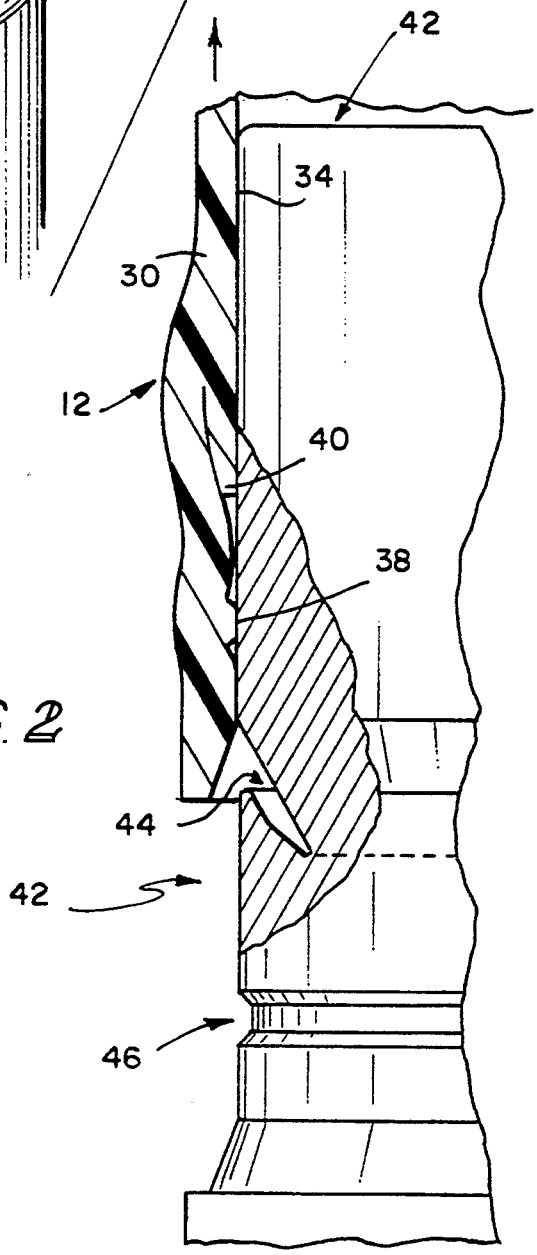
FIG. 2 is an enlarged sectional view of a portion of the lid shown in FIG. 1 and a mold core as the lid is being moved in an upward direction to strip the lid out of the mold and disengage the inner portion of the lid from the mold core.

The top end of an aerosol spray can 10 and a sturdy lid 12 for mounting on the can 10 are shown in FIG. 1. The improved lid 12 is configured to engage the can 10 and distribute a heavy load applied to the lid 12 down onto the can 10. Because the novel lid 12 has excellent stacking strength, it can withstand heavy loads. Also, the lid 12 is configured to make it easy to strip the lid 12 out of its mold as shown in FIG. 2.

The can 10 is a well-known conventional design and includes a cylindrical body 14, a closure member 16, and a push-to-spray button 18. The closure member 16 is a two-piece metal stamping that is assembled and mounted on the body 14 to cover a top opening formed in the cylindrical body 14. The first piece is a dome-shaped base 20 formed to include an annular foundation 22, a rolled annular lip 24 lying around the foundation 22 and connecting to the cylindrical body 14, and an annular top rim 26. The second piece is a round top cover 28 that is coupled to the annular top rim 26 and formed to support a typical push-to-spray button such as button 18.

The lid 12 is configured to mount directly onto the rolled annular lip 24 provided on can 10. Of course, it will be understood that lid 12 is configured to mount on a wide variety of cans other than can 10. Can 10 is representative of many well-known cans and is illustrated herein to provide a base on which to mount the sturdy lid 12.

As shown in FIG. 1, sturdy lid 12 includes a cylindrical shell 30 and a round top wall 32. Shell 30 includes a cylindrical inner wall 34 having a lower circular edge 36. A series of circumferentially spaced-apart annular lid-retaining portions or ring 38 are appended to cylindrical inner wall 34 and arranged to lie in close proximity to the lower circular edge 36. An annular hook-shaped load-distributing member 40 is appended to the cylindrical inner wall 34 and arranged to lie above the set of annular lid-retaining portions or ring 38. It is this hook-shaped member 40 that is configured to engage the rolled annular lip 24 when the lid 12 is mounted on can 10 as shown in FIGS. 3 and 4 to enhance the stacking strength of the lid 12.

One step in the lid-molding process is illustrated in FIG. 2. Although the entire mold used to mold lid 12 out of plastics material is not shown, a core 42 included in the mold and configured to form the cylindrical inner wall 34, lid-retaining portions or ring 38, and hook-shaped load-distributing portion 40, etc. is shown in FIG. 2.

Mold core 42 is formed to include an annular cavity 44 for forming hook-shaped load-distributing portion 40 and another cavity 46 for forming the series of circumferentially spaced-apart lid-retaining portions or ring 38. As shown in FIG. 2, it is easy to strip the lid 12 from its mold and off the mold core 42 because of the shape and orientation of the axially downwardly and radially inwardly extending conical shape of the annular hook-shaped load-distributing portion 40. Essentially, the slanting angle of the hook-shaped portion 40 allows the lid 12 to flex as it is ejected from the mold (not shown) and stripped from the mold core 42 (even if the lid 12 is made out of polypropylene) without shearing or permanently deforming the hook-shaped portion 40 or the lid 12.

Figure 3:
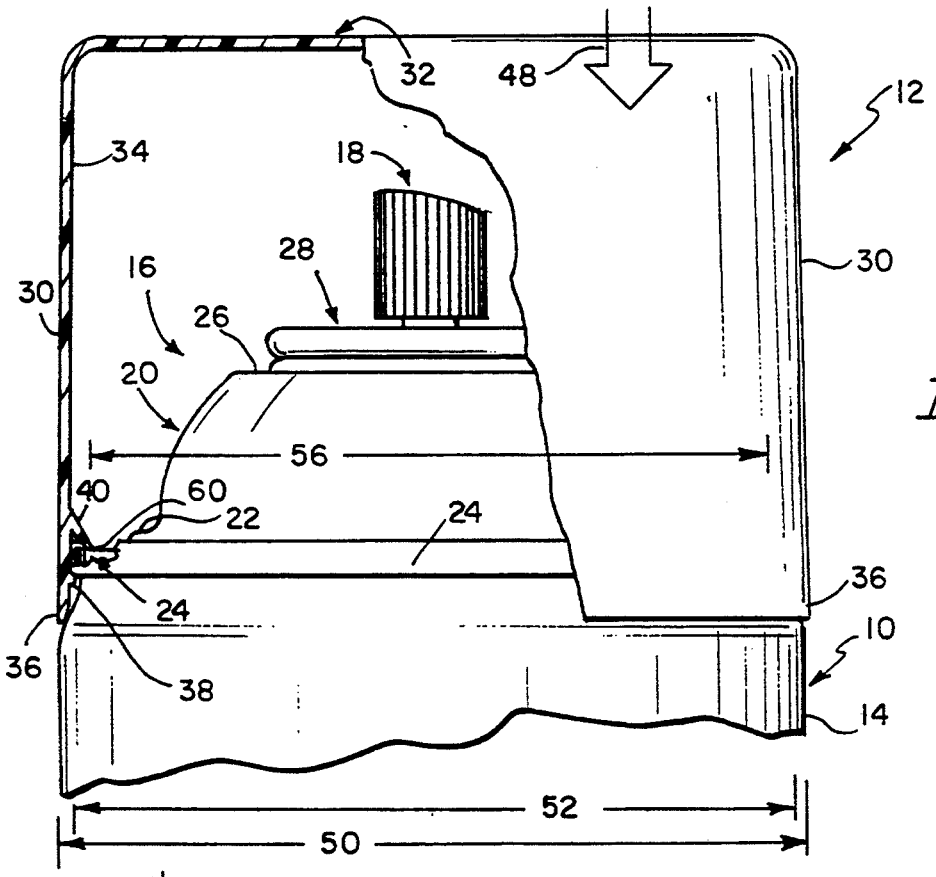
FIG. 3 is a side elevation of a an aerosol spray can and the sturdy lid of FIG. 1, with portions of the lid broken away, showing the annular hook-shaped load-distributing member appended to the cylindrical inner wall of the hollow lid shell and engaging a top edge of an annular lip formed on the closure member.
Figure 4:
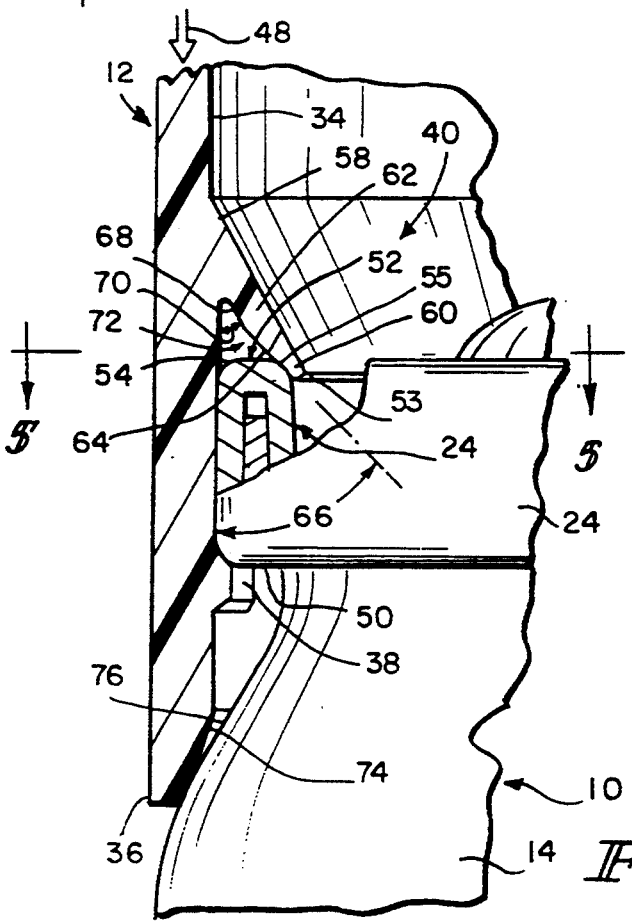
FIG. 4 is an enlarged view of the sturdy lid of FIGS. 1 and 3 showing the annular lip trapped between an annular slanted portion of the overlying annular hook-shaped member and an underlying lid-retaining portion.
Figure 5:
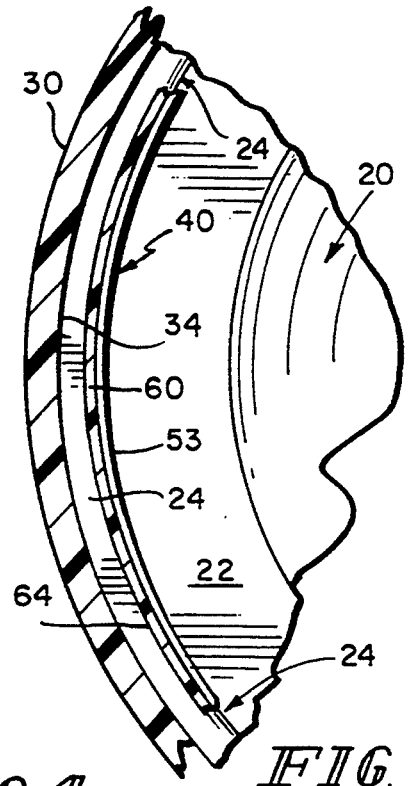
FIG. 5 is a transverse cross section taken along line 5—5 of FIG. 4 showing a top portion of the annular lip lying between the radially outer cylindrical side wall of the lid shell and the radially inner annular tip of the annular hook-shaped load-distributing member.

The lid 12 is shown in its mounted position on can 10 in FIG. 3. The lid 12 covers the push-to-spray button 18 and thus serves as a guard against inadvertent depression of button 18 and release of the pressurized contents of can 10. Any heavy weight, such as a compression load represented by double arrow 48, applied to the top wall 32 of lid 12 will be distributed to can 10 by means of the engagement of the annular hook-shaped load-distributing portion 40 on the rolled annular lip 24 of closure member 16. This load 48 could be a static load caused by a stack of cans or other heavy weight above lid 12 or it could be a dynamic load caused, for example, by jostling a box (not shown) containing can 10 and lid 12 during shipping or warehousing.

Some dimensions of one presently preferred embodiment of lid 12 are illustrated in FIG. 3. Lid 12 is configured to mount on a can having a height of 714 mm and an outer diameter of 214 mm. Lid 12 itself has an outer diameter 50 of 2.78 inches (70.6 mm). Also, the radially innermost edge 53 of the annular hook-shaped load-distributing portion 40 defines a circle having a diameter 56 of about 2.58 inches (65.5 mm).

The annular hook-shaped load-distributing member 40 includes an annular proximal portion or ring 58 appended to the cylindrical inner wall 34, an annular distal portion or ring 60 including radially innermost edge 53, and an annular slanted portion or ring 62 extending between proximal portion 58 and distal portion 60. The annular slanted portion 62 includes a conical ramp surface 64 facing toward the cylindrical inner wall 34 and engaging the top edge 52 of the rolled annular lip 24. The conical ramp surface 64 and the cylindrical inner wall 34 cooperate to define an acute included angle 66 of about 45° therebetween. The proximal portion 58 includes an annular side wall 68 facing toward the cylindrical inner wall 34 and lying between the inner wall 34 and the conical ramp surface 64. The annular side wall 68 is inclined as shown in FIG. 4 to cooperate with the cylindrical inner wall 34 to define an acute included angle 70 of about 30° therebetween.

As also shown in FIG. 4, the annular slanted portion 62 of hook-shaped member 40 and the inner wall 34 of shell 30 cooperate to define an annular lip-receiving channel 72 therebetween. In use, whenever a load such as compression load 48 is applied to lid 12, the load is distributed from the lid 12 to the can 10 by engagement of the conical ramp surface 64 of hook-shaped member 40 and the top edge 52 of the rolled annular lip 24. The top edge 52 includes a radially outer circular rim 54 and a radially inner circular rim 55. While a very large load 48 might cause a small amount of deformation of rolled annular lip 24 as a result of relative movement between hook-shaped member 40 and annular lip 24, hook-shaped member 40 will continue to hook onto the annular lip 24 to distribute the load 48 evenly onto the lip 24 of the can 10. This increases the sturdiness of the lid 12 and reduces the chance that the lid 12 will deform or move to engage and activate the push-to-spray button 18 while the lid 12 is mounted on the can 10. In addition, the lower edge 36 of cylindrical shell 30 can be formed as shown in FIG. 4 to include a conical surface 74 for camming against an exterior surface 76 of the body 14.

The lid 12 is held in place on the can 10 by the lid-retaining portions 38. Although the illustrated embodiment shows a series of circumferentially spaced-apart annular portions 38, these portions 38 could be replaced by a single annular ring (not shown). Once the lid 12 is mounted on the can 10, the rolled annular lip 24 is trapped between the overlying annular hook-shaped load-distributing member 40 and the annular lid-retaining portions 38 as shown best in FIGS. 3 and 4.

Although the invention has been described in detail with reference to certain preferred embodiments, variations and modifications exist within the scope and spirit of the invention as described and defined in the following claims.

I claim:

1. A lid for mounting on a can having a body with an outer wall and a top closure member, the body being formed to include a top opening, and the top closure member covering the top opening and having an annular lip for connecting the top closure member to a top of the outer wall of the body and lying around the top opening in the body, the lid comprising a shell having an outer peripheral wall formed to include chamber means for containing the closure member once the shell is mounted on the body of the can, first engaging means for engaging an underside portion of the annular lip adjacent a top of the outer body wall to retain the shell in a mounted position on the body so that the closure member is contained in the chamber means, the first engaging means being appended to the outer peripheral wall of the shell and arranged to lie inside the chamber means, and second engaging means for engaging an upper side portion of the annular lip adjacent the outer body wall to distribute an external load applied to the shell to the closure member and body without dismounting the shell from the body, the second engaging means being appended to the outer peripheral wall of the shell and extending around a majority of the circumference of the shell, spaced from the first engaging means, and arranged to lie inside the chamber means in spaced-apart relation to the first engaging means, the second engaging means having a downwardly opening, hook-shaped flange opening toward the first engaging means and engaging the annular lip.

2. The lid of claim 1, wherein the shell includes a cylindrical side wall, each of the first and second engaging means are appended to the cylindrical side wall, the annular lip includes a bottom edge adjacent to the body and a top edge facing away from the body, the first engaging means includes a first ring engaging the bottom edge of the annular lip, and the hook-shaped flange is configured to define a second ring engaging the top edge of the annular lip.

3. The lid of claim 2, wherein the cylindrical side wall includes a bottom edge formed to include a lower conical cam ramp facing in a radially inward direction toward the body and the first ring is positioned to lie intermediate the conical cam ramp and the second ring.

4. The lid of claim 1, wherein the shell includes a cylindrical side wall, the hook-shaped flange has a conical shape and is oriented in the chamber means to lie in an inverted position converging in a direction toward the first engaging means, the hook-shaped flange includes an annular slanted portion that cooperates with the cylindrical side wall to define an annular lip-receiving channel therebetween, and the annular lip is positioned to lie in the annular lip-receiving channel while the shell is mounted on the body of the can.

5. The lid of claim 4, wherein the annular lip includes a top edge, the top edge of the annular lip includes a radially outer circular rim facing toward the cylindrical side wall and a radially inner circular rim facing toward a central vertical axis of the closure member, and the annular slanted portion of the hook-shaped flange engages the radially inner circular rim of the annular lip.

6. The lid of claim 1, wherein the shell includes a cylindrical side wall, the hook-shaped flange includes an annular proximal portion appended to the cylindrical side wall, an annular distal portion, and an annular slanted portion extending between the annular proximal portion and the annular distal portion, the annular slanted portion and the cylindrical side wall cooperate to define an acute included angle therebetween, and the annular slanted portion includes a conical ramp surface facing toward the cylindrical side wall and engaging a top edge of the annular lip formed on the closure member.

7. The lid of claim 6, wherein the top edge of the annular lip includes a radially outer circular rim facing toward the cylindrical side wall and a radially inner circular rim facing toward a central vertical axis of the closure member and the conical ramp surface of the annular slanted portion engages the radially inner circular rim of the annular lip.

8. The lid of claim 1, wherein the shell includes a cylindrical side wall and a top wall appended to the cylindrical side wall and the hook-shaped flange is a thin-walled frustum of a right circular cone arranged in an inverted position in the chamber means and configured to include a circular base appended to the cylindrical side wall and a conical ramp portion oriented to converge in a direction away from the top wall and positioned to engage the annular lip formed on the closure member.

9. The lid of claim 8, wherein the annular lip includes a bottom edge adjacent to the body and a top edge facing away from the body, the first engaging means includes annular sections appended to the cylindrical side wall and positioned to engage the bottom edge of the annular lip to retain the shell in a mounted position on the can, and the conical ramp portion is arranged to engage the top edge of the annular lip while the shell is in its mounted position on the can and is configured to distribute a compression load applied to the shell to the annular lip and body while the shell is in its mounted position on the can.

10. A lid for mounting on a can having a body with an outer wall and a top closure member, the body being formed to include a top opening, and the top closure member covering a top of the top opening and having an annular lip for connecting the top closure member to a top of the outer wall of the body and lying around the top opening in the body, the lid comprising a shell having an outer peripheral wall and formed to include chamber means for containing the closure member once the shell is mounted on the body of the can, first engaging means for engaging the annular lip to retain the shell in a mounted position on the body so that the closure member is contained in the chamber means, the first engaging means being appended to the outer peripheral wall of the shell and arranged to lie inside the chamber means, and second engaging means for engaging the annular lip to distribute an external load applied to the shell to the closure member and body without dismounting the shell from the body, the second engaging means being appended to the outer peripheral wall of the shell and extending around a majority of the circumference of the shell, spaced from the first engaging means and arranged to lie inside the chamber means in spaced-apart relation to the first engaging means, the second engaging means having a downwardly opening, hook-shaped flange opening toward the first engaging means and engaging the annular lip, the annular lip including a bottom edge adjacent to a top of the outer wall of the body and a top edge facing away from the top of the outer wall of the body, the first engaging means being arranged to engage the bottom edge of the annular lip, and the hook-shaped flange being arranged to hook onto the top edge of the annular lip.

11. The lid of claim 10, wherein the hook-shaped flange includes a proximal portion appended to the shell and a conical ramp portion arranged to engage the top edge of the annular lip formed on the closure member.

12. The lid of claim 11, wherein the shell includes a cylindrical side wall, the proximal portion is appended to the cylindrical side wall, and the conical ramp portion and the cylindrical side wall cooperate to define an acute included angle and an annular lip-receiving channel therebetween.

13. The lid of claim 12, wherein the top edge of the annular lip includes a radially outer circular rim facing toward the cylindrical side wall and a radially inner circular rim facing toward a central vertical axis of the closure member and the conical ramp portion of the hook-shaped flange engages the radially inner circular rim of the annular lip.

14. The lid of claim 10, wherein the hook-shaped flange and the shell cooperate to form an annular channel inside the chamber means and the annular lip first into the annular channel.

15. A lid for mounting on a can having a body with an outer wall and a top closure member, the body being formed to include a top opening, and the top closure member covering the top opening and having an annular lip for connecting the top closure member to a top of the outer wall of the body and lying around the top opening in the body, the lid comprising a shell having an outer peripheral wall with an inner surface facing toward the closure member, a lid-retaining portion appended to the inner surface of the outer peripheral wall of the shell and positioned to engage an underside portion of the annular lip adjacent a top of the outer body wall, and means for distributing an external compression load applied to the lid to urge the lid toward the can onto the closure member, the distributing means including a hook-shaped load-distributing member appended to the inner surface of the outer peripheral wall of the shell to extend around a majority portion of the circumference of the inner surface of the outer peripheral wall of the shell, spaced from the lid-retaining portion, and positioned to hook onto and engage an upper side portion of the annular lip.

16. The lid of claim 15, wherein the hook-shaped load-distributing member is a conical ring positioned to lie above the annular lip.

17. The lid of claim 16, wherein the annular lip includes a bottom edge adjacent to the body and a top edge facing away from the body, the lid-retaining portion engages the bottom edge of the annular lip, and the conical ring includes a radially inwardly, axially downwardly sloped surface facing toward the lid-retaining portion and engaging the top edge of the annular lip.

18. The lid of claim 15, wherein the closure member includes a central portion, the annular lip encircles the central portion and lies in spaced-apart relation to the central portion to define a circular channel therebetween and the hook-shaped load-distributing member is a conical ring positioned to extend into the circular channel.

19. The lid of claim 18, wherein the annular lip includes a bottom edge adjacent to the body and a top edge facing toward the conical ring and the conical ring includes a sloped surface engaging the top edge of the annular lip.

20. The lid of claim 15, wherein the annular lip includes a top edge facing toward the hook-shaped load-distributing member, the top edge includes a radially outer circular rim facing toward the inner wall of the shell and a radially inner circular rim facing toward a central vertical axis of the closure member, and the hook-shaped load-distributing member includes an annular slanted portion engaging the radially inner circular rim of the annular lip.

21. A lid for mounting on a can having a body with an outer wall and a top closure member, the body being formed to include a top opening, and the closure member covering the top opening and having an annular lip for connecting the top closure member to a top of the outer wall of the body and lying around the top opening in the body, the lid comprising a shell having an outer peripheral wall with an inner surface wall facing toward the closure member, a load-distributing member having a cam ramp engaging an upper side portion of the annular lip, the load-distributing member being appended to the inner surface of the outer peripheral wall of the shell and extending around a majority of the circumference of the inner surface of the outer peripheral wall of the shell, and the cam ramp being inclined to cooperate with the inner surface of the outer peripheral wall of the shell to define an acute included angle therebetween, and means on the inner surface of the outer peripheral wall of the shell, spaced from the load-distributing member for engaging an underside portion of the annular lip adjacent the top of the outer wall of the body to retain the shell in a mounted position on the cam ramp.

22. The lid of claim 21, wherein the load-distributing member includes a proximal base portion appended to the inner wall, a distal tip portion located in a radially inwardly offset position relative to the inner wall, and a slanting portion extending between the base and tip portions and including the cam ramp.

23. The lid of claim 22, wherein the slanting portion has a conical shape.

24. The lid of claim 22, wherein the slanting portion is a conical ring and the cam ramp is a continuous ring.

25. The lid of claim 21, wherein the load-distributing member is a conical ring positioned to lie above the annular lip.

26. The lid of claim 25, wherein the annular lip includes a bottom edge adjacent to the body and a top edge facing away from the body, and the cam ramp is formed on the conical ring and arranged to face toward the inner wall and engage the top edge of the annular lip.

27. A lid for mounting on a can having a body and a closure member, the body being formed to include a top opening, and the closure member covering the top opening and having an annular lip engaging the body and lying around the top opening in the body, the lid comprising a shell having an inner wall facing toward the closure member, a load-distributing member having a cam ramp engaging the annular lip, the load-distributing member being appended to the inner wall, and the cam ramp being inclined to cooperate with the inner wall to define an acute included angle therebetween, and means for engaging the annular lip to retain the shell in a mounted position on the cam ramp, the load-distributing member including a proximal base portion appended to the inner wall, a distal tip portion located in a radially inwardly offset position relative to the inner wall, and a slanting portion extending between the base and tip portions and including the cam ramp, the base portion including an annular side wall facing toward the inner wall of the shell and lying between the inner wall and the cam ramp, the annular side wall being inclined to cooperate with the inner wall to define an second acute included angle therebetween, and said second acute included angle being smaller than said acute included angle causing the annular side wall to slope at a steeper angle than the cam ramp.

28. The lid of claim 27, wherein said acute included angle is about 45° and said second acute included angle is about 30°.

29. The lid of claim 27, wherein the inner wall and the cam ramp are situated in spaced-apart relation to define an annular lip-receiving channel therebetween and the annular lip engages the inner wall and the cam ramp and lies in spaced-apart relation to the side wall.

* * * * *